US010161403B2

(12) United States Patent
Sumimoto

(10) Patent No.: US 10,161,403 B2
(45) Date of Patent: Dec. 25, 2018

(54) VACUUM PUMP

(71) Applicant: SHIMADZU CORPORATION, Kyoto (JP)

(72) Inventor: Shin Sumimoto, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 815 days.

(21) Appl. No.: 14/149,108

(22) Filed: Jan. 7, 2014

(65) Prior Publication Data

US 2014/0205431 A1 Jul. 24, 2014

(30) Foreign Application Priority Data

Jan. 22, 2013 (JP) ..... 2013-009113
Nov. 20, 2013 (JP) ..... 2013-239906

(51) Int. Cl.
*F04D 19/04* (2006.01)
*F04D 29/54* (2006.01)

(52) U.S. Cl.
CPC ..... *F04D 19/042* (2013.01); *F04D 29/542* (2013.01); *F04D 29/544* (2013.01)

(58) Field of Classification Search
CPC ..... F04D 19/04; F04D 19/042; F04D 19/044; F04D 19/046; F04D 29/542; F04D 29/544; F05B 2230/24; B23P 2700/12
USPC ..... 415/90; 417/423.4
See application file for complete search history.

(56) References Cited

U.S. PATENT DOCUMENTS 4,309,143 A * 1/1982 Klatt ..... F04D 19/042 29/889.23
7,384,241 B2 * 6/2008 Watanabe ..... B21D 53/78 29/557
7,824,153 B2 * 11/2010 Akimoto ..... F04D 19/042 415/191
8,257,033 B2 9/2012 Oishi
(Continued)

FOREIGN PATENT DOCUMENTS

EP 1918588 A2 * 5/2008 ..... F04D 19/042
GB 1275386 A * 5/1972 ..... F04D 19/042
JP 58-98696 6/1983
(Continued)

OTHER PUBLICATIONS

English translation of Chinese Office Action dated Nov. 18, 2015 for corresponding Chinese Application No. 201310722728.0.
(Continued)

*Primary Examiner* — Kenneth Bomberg
*Assistant Examiner* — Jesse Prager
(74) *Attorney, Agent, or Firm* — Renner Otto Boisselle & Sklar, LLP

(57) ABSTRACT

A vacuum pump has an exhaust portion in which rotating blade portions and stationary blade portions are laminated in multiple stages. Each of the plurality of stator blades in one stage of the stationary blade portion is three-dimensionally connected to the stationary blade portion main body by an inner circumferential side support portion on the inner circumferential end side, and three-dimensionally connected to the stationary blade portion main body by an outer circumferential side support portion on the outer circumferential end side, and a cutout is provided in ag circumferential front end of the outer circumferential side support portion.

5 Claims, 10 Drawing Sheets

(56) References Cited

U.S. PATENT DOCUMENTS

| | | | | |
|---|---|---|---|---|
| 2006/0280595 | A1* | 12/2006 | Stoll | F04D 19/042 415/90 |
| 2014/0010659 | A1* | 1/2014 | Shi | F04D 19/042 416/204 R |

FOREIGN PATENT DOCUMENTS

| | | | | |
|---|---|---|---|---|
| JP | 63-119890 | | 8/1988 | |
| JP | 2003-269365 | | 9/2003 | |
| JP | 2005-105851 | | 4/2005 | |
| JP | 2006090231 | A * | 4/2006 | |
| JP | 2009-002233 | | 1/2009 | |
| JP | WO 2012081287 | A1 * | 6/2012 | F04D 19/042 |

OTHER PUBLICATIONS

Office Action for corresponding Japanese Patent App. No. 2013-239906, dated Jun. 27, 2017 (English translation).

* cited by examiner

VACUUM PUMP

BACKGROUND OF THE INVENTION

1. Field of the Invention

This invention relates to a vacuum pump having an exhaust portion formed by a rotating blade portion and a stationary blade portion.

2. Description of the Related Art

In a vacuum pump such as a turbo-molecular pump, a rotor having rotating blade portions arranged in multiple stages is rotated at high speed in a pump container, and a gas molecule is moved from an intake port side to an exhaust port side by the rotating blade portions and stationary blade portions arranged between the stages of the rotating blade portions.

Each stage of the rotating blade portions has rotor blades, and each stage of the stationary blade portions has stator blades. The stationary blade portions are supported at predetermined intervals by spacers arranged on outer circumferences of the stationary blade portions. The stationary blade portions are formed into one ring shape by combining a pair of halved ring shape members.

The rotor blades and the stator blades are formed so as to be inclined with respect to a rotation surface of the rotor. A blade angle with respect to the rotation surface is generally formed so as to be larger on the upper stage side than the lower stage side.

As a method of manufacturing the stationary blade portions, there are a method of forming by mechanical working and a method of forming by plastic working. However, the method of manufacturing by the plastic working is advantageous in terms of cost. For example, the fiftieth paragraph of Japanese Unexamined Patent Application Publication No. 2005-105851 describes a procedure of manufacturing by the plastic working. This procedure includes:

(1) a step of preparing a disc plate made of metal such as aluminum, (2) a step of forming three cut lines on the disc plate along outlines of plural rows of blade portions (stator blades) by etching, and (3) a step of forming the blade portions by a predetermined inclination angle by pressing.

The above manufacturing method is to form the three cuts along outline shapes of the blade portions, and plastically deform the cut inner regions by the pressing, so as to form the blade portions by a predetermined blade angle. Outer circumferential side ends and inner circumferential side ends of the blade portions are isolated from the disc plate.

That is, there is no member for supporting the blade portions between the disc plate and the outer circumferential side ends of the blade portions, and between the disc plate and the inner circumferential side ends of the blade portions. Therefore, the blade portion, that is, the stator blades have small rigidity, and the blade angle of the stator blades is easily changed.

SUMMARY OF THE INVENTION

A vacuum pump has an exhaust portion in which rotating blade portions and stationary blade portions are laminated in multiple stages. In at least one stage of the stationary blade portion among the plurality of stationary blade portions laminated in the multiple stages. A plurality of stator blades extended in a radial manner with a predetermined width in the circumferential direction and inclined by a predetermined blade angle with respect to a stationary blade portion main body. A plurality of exhaust openings through which an gas current is guided from upstream to downstream by the plurality of stator blades are provided. Each of the plurality of stator blades in one stage of the stationary blade portion is three-dimensionally connected to the stationary blade portion main body by an inner circumferential side support portion on the inner circumferential end side and three-dimensionally connected to the stationary blade portion main body by an outer circumferential side support portion on the outer circumferential end side. A cutout is provided in a circumferential front end of the outer circumferential side support portion.

Each of the plurality of stator blades is formed into a substantial quadrangle elongated in the radial direction in a plan view, and includes an inner circumferential end extended in the circumferential direction on the inner circumferential end side of the stator blade, an outer circumferential end extended in the circumferential direction on the outer circumferential end side of the stator blade, a base end extended in the radial direction for connecting a base part of the inner circumferential end and a base part of the outer circumferential end, and a side end facing the base end in the circumferential direction and being extended in the radial direction, the inner circumferential end, the outer circumferential end, and the base end are connected to the stationary blade portion main body, and the side end is separated from the stationary blade portion main body so as to define the exhaust opening, and the cutout is provided in a front end of the outer circumferential end crossing the side end.

The cutout is formed into a quadrangle in a plan view, and is long in the circumferential direction and short in the radial direction.

The inner circumferential side support portion is provided over the entire length of the inner circumferential end, and the outer circumferential side support portion is provided in a region of a part of the entire length from the base part of the outer circumferential end to the side end.

A length of the cutout is less than a half of a length of the outer circumferential end.

The stator blades are formed by drawing.

BRIEF DESCRIPTION OF THE DRAWINGS

FIG. 9A is a sectional view taken along the line IXa-IXa in FIG. 2 at the time of the drawing, and FIG. 9B is a sectional view taken along the line IXb-IXb in FIG. 2 at the time of the drawing.

DETAILED DESCRIPTION OF PREFERRED EMBODIMENTS

Figure 1:
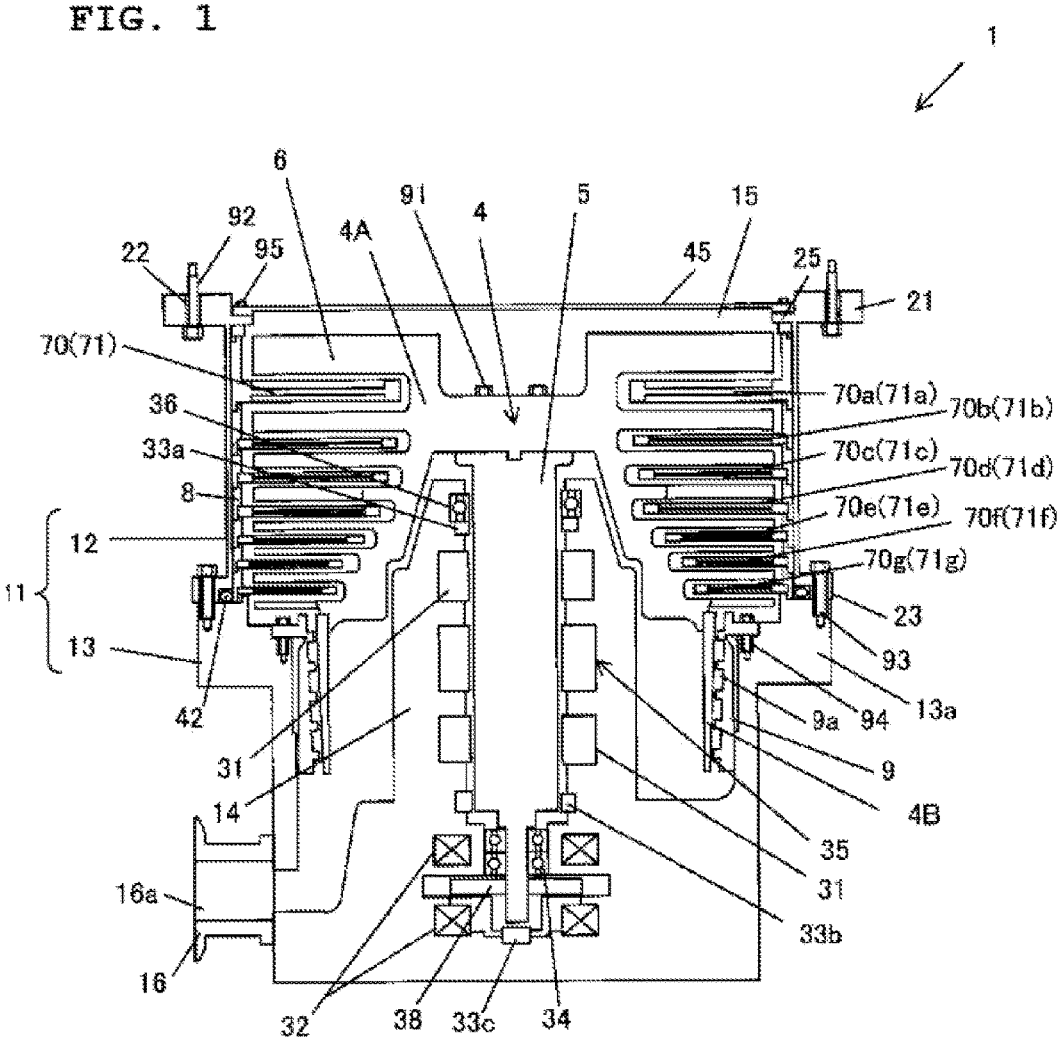
FIG. 1 is a sectional view of a turbo-molecular pump serving as one embodiment of a vacuum pump according to this invention.

Hereinafter, referring to the drawings, a vacuum pump according to the present invention will be described with a turbo-molecular pump as one embodiment.

—Entire Configuration of Vacuum Pump—

FIG. 1 is a sectional view of a turbo-molecular pump 1. The turbo-molecular pump 1 includes a pump container 11 formed by a casing member 12 and a base 13 fixed to the casing member 12.

The casing member 12 has a substantially cylindrical shape, and formed by for example SUS, and an upper flange 21 is formed in an upper end. A disc shape intake port 15 is formed on the inner side of the upper flange 21 of the casing member 12. Through holes 22 for bolt insertion are formed in the upper flange 21 at substantially equal intervals along the circumferential direction. The turbo-molecular pump 1 is attached to an external device such as semiconductor manufacturing device by inserting bolts 92 into the through holes 22 of the upper flange 21.

A rotor 4 and a rotor shaft 5 attached coaxially with an axis of the rotor 4 are accommodated in the pump container 11. The rotor 4 and the rotor shaft 5 are fixed by bolts 91.

The rotor 4 includes a rotor upper portion 4A, and a rotor lower portion cylindrical portion 4B jointed to a lower surface of the rotor upper portion 4A. The rotor upper portion 4A is made of, for example, an aluminum alloy. In the rotor upper portion 4A, a plurality of rotating blade portions 6 is arranged in multiple stages at intervals in the axial direction in a radial manner in the direction (horizontal direction) orthogonal to the up and down direction (axial direction). Each of the rotating blade portions 6 has rotor blades. Stationary blade portions 70 having stator blades 71 are arranged between the stages of the plurality of rotating blade portions 6. The stationary blade portions 70 are formed into a ring shape formed by combining a pair of halved rings. Each of the stationary blade portion 70 is nipped by ring shape spacers 8 arranged along an inner circumferential surface of the casing member 12, and the rotating blade portions 6 and the stationary blade portions 70 are alternately laminated in multiple stages, so as to form a high-vacuum blade exhaust portion.

A ring shape threaded stator 9 is fixed to the base 13 by bolts 94 on the outer circumferential side of the rotor lower portion cylindrical portion 4B. A threaded groove portion 9*a* is formed in the threaded stator 9. A low-vacuum threaded groove exhaust portion is formed by the rotor lower portion cylindrical portion 4B of the rotor 4 and the threaded stator 9.

It should be noted that although the structure of forming the threaded groove portion 9*a* in the threaded stator 9 is shown as an example in FIG. 1, the threaded groove portion 9*a* may be formed on an outer circumferential surface of the rotor lower portion cylindrical portion 4B.

The base 13 is made of, for example, an aluminum alloy, and a center tube portion 14 in which a disc shape hollow part is formed for inserting the rotor shaft 5 is formed in a center part of the base 13. On the inner side of the center tube portion 14, a motor 35, (two) radial magnetic bearings 31, (a pair of upper and lower) thrust magnetic bearings 32, radial displacement sensors 33*a*, 33*b*, an axial displacement sensor 33*c*, mechanical bearings 34, 36, and a rotor disc 38 are attached.

The rotor shaft 5 is supported by the (two) radial magnetic bearings 31 and the (pair of upper and lower) thrust magnetic bearings 32 in non-contact manner. A position of the rotor shaft 5 at the time of rotation is controlled based on a radial position and an axial position detected by the radial displacement sensors 33*a*, 33*b* and the axial displacement sensor 33*c*. The rotor shaft 5 rotatably and magnetically floated up by the magnetic bearings 31, 32 is driven and rotated at high speed by the motor 35.

The mechanical bearings 34, 36 are mechanical bearings for emergency, and when the magnetic bearings are not operated, the rotor shaft 5 is supported by the mechanical bearings 34, 36.

An exhaust port 16 is provided in the base 13, and an exhaust opening 16*a* is provided in the exhaust port 16.

A lower flange 23 of the casing member 12 and an upper flange 13*a* of the base 13 are fixed by bolts 93 through a seal member 42, so that the pump container 11 is formed.

A protection net 45 is arranged so as to cover the intake port 15 formed on the inner side of the upper flange 21 of the casing member 12. The protection net 45 is fastened to a step portion 25 formed on the inner side of the upper flange 21 by bolts 95.

—Description of Stationary Blade Portion 70—

In the example shown in FIG. 1, the stationary blade portions 70 are formed in seven stages shown by reference signs 70*a* to 70*g*. Stator blades 71*a* are formed in the top stationary blade portion 70*a*, stator blades 71*b* are formed in the stationary blade portion 70*b* which is the second from the top, and then stator blades 71*c* to 71*g* are respectively formed in the stationary blade portions 70*c* to 70*g* which are the third to seventh from the top. As described above, the stator blades 71*a* to 71*g* of the stages are arranged in a radial manner centering on an axis of the rotor shaft 5.

Regarding inclination angles, so-called blade angles of the stator blades 71*a* to 71*g* with respect to the planar direction orthogonal to a rotor rotation axis, the top stator blades 71*a* have the largest angle, the stator blades 71*b* to 71*d* have the next largest angle, and the stator blades 71*e* to 71*g* have the smallest angle. Hereinafter, the stator blades 71*b* to 71*d* will be called the stator blades having a large blade angle and a large blade height, and the stator blades 71*e* to 71*g* will be called the stator blades having a small blade angle and a small blade height.

In one embodiment of the present invention, the stator blades 71*a* are manufactured by mechanical working, and the stator blades 71*b* to 71*g* are manufactured by drawing.

As described below, the stator blades 71*b* to 71*g* manufactured by the drawing are classified into the stator blades 71*b* to 71*d* having the large blade angle and the large blade height, and the stator blades 71*e* to 71*g* having the small blade angle and the small blade height, and these are formed into different shapes.

Hereinafter, the stator blades 71*b* to 71*d* having the large blade angle and the large blade height will be described with reference to FIGS. 2 and 3.

Figure 2:
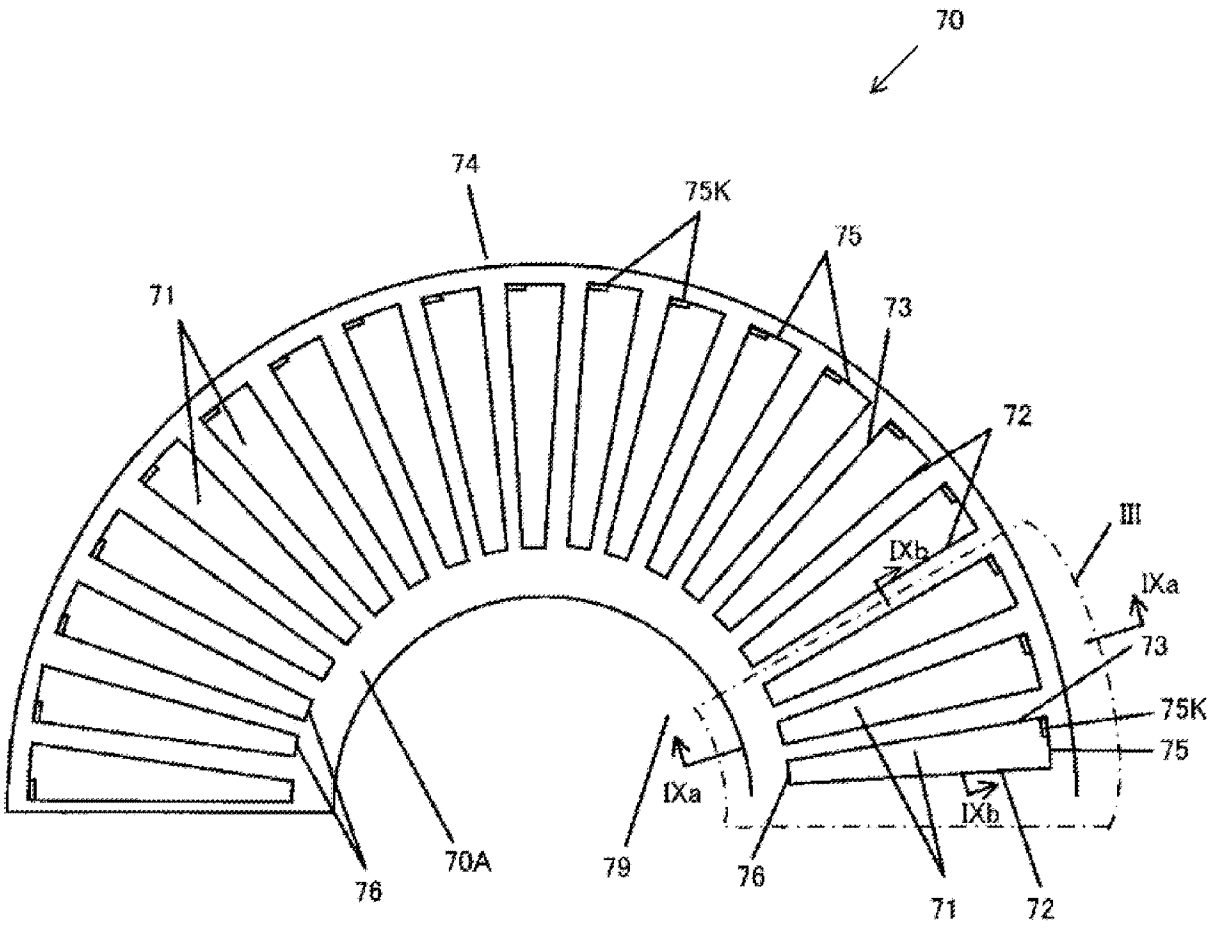
FIG. 2 is a plan view of stationary blade portions 70*b* to 70*d* having stator blades 71*b* to 71*d* having a large blade angle and a large blade height.
Figure 3A:
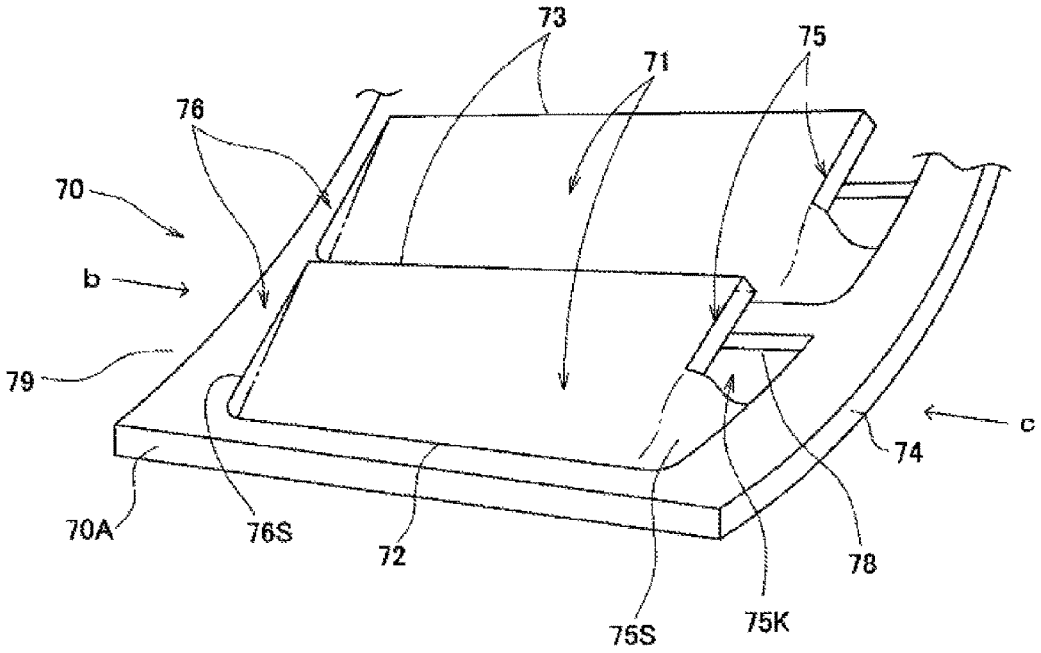
FIG. 3A is an enlarged perspective view of the stationary blade portion 70 of a region III in FIG. 2 when seen from the outer circumferential side.
Figure 3B:
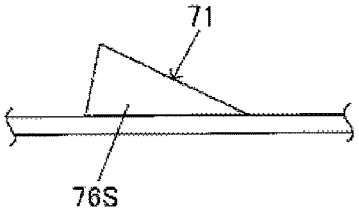
FIG. 3B is view of the stator blade when seen from the inner circumferential side.
Figure 3C:
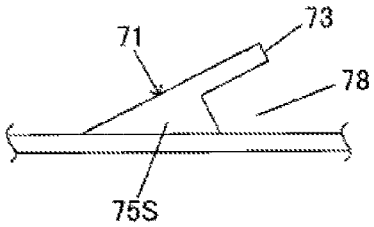
FIG. 3C is view of the stator blade when seen from the outer circumferential side.

FIG. 2 is a plan view of the stationary blade portions 70*b* to 70*d* having the stator blades 71*b* to 71*d* having the large blade angle and the large blade height. FIG. 3A is an enlarged perspective view of the stationary blade portion 70 of a region III in FIG. 2 when seen from the outer circumferential side. FIG. 3B is view of the stator blade when seen from the inner circumferential side. FIG. 3C is view of the stator blade when seen from the outer circumferential side.

Referring to FIGS. 2 and 3, in the stator blades 71*b* to 71*d* according to the present invention, an inner circumferential side end 76 and an outer circumferential side end 75 of the stator blade 71 are connected to a stationary blade portion main body 70A by support portions 76S, 75S. As described above, the blade angle and the blade height are larger as the stator blade is more close to the top stage. Especially, cracking is easily generated in the support portion 75S of the outer circumferential side end 75 of the stator blades 71*b* to 71*d* having the large blade angle and the large blade height. Therefore, in the stator blades 71*b* to 71*d* having the large blade angle and the large blade height, a cutout 75K is preliminarily formed on the front end side of the support portion 75S of the outer circumferential side end 75 in particular, so as to prevent generation of the cracking. Since the inner circumferential side end 76 has a lower blade height than the outer circumferential side end 75, there is no need for forming the cutout 75K in the support portion 76S thereof.

It should be noted that since the cracking following the drawing is not easily generated in the support portion 75S of the outer circumferential side end 75 of the stator blades 71*e* to 71*g* having the small blade angle and the small blade height, there is no need for forming the cutout 75K in the support portion 75.

In the following description, the stationary blade portion 70 will represent the stationary blade portions 70*b* to 70*d*, and the stator blade 71 will represent the stator blades 71*b* to 71*d*. Although the stationary blade portion 70 is formed into a ring shape by combining a pair of half-disc shape members, a half-disc member will serve as the stationary blade portion 70 in the following description.

Figure 4:
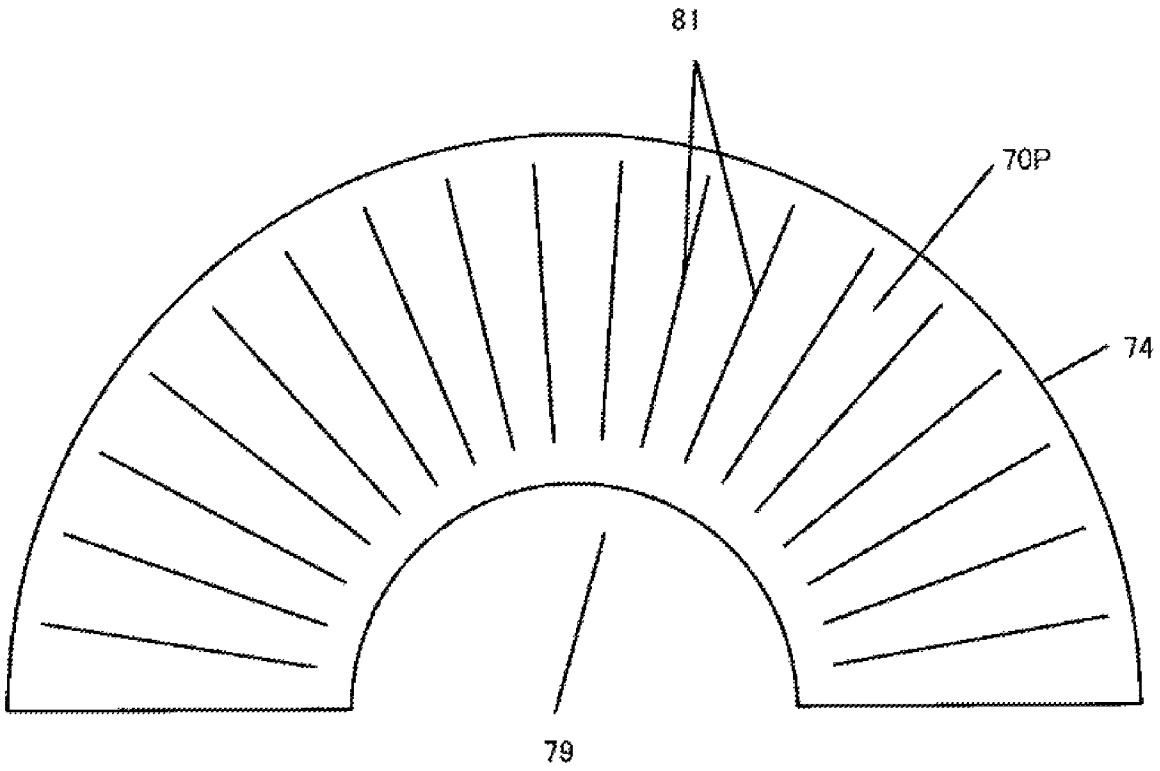
FIG. 4 is a plan view of a half-disc plate for illustrating a manufacturing method of the stationary blade portion.
Figure 5:
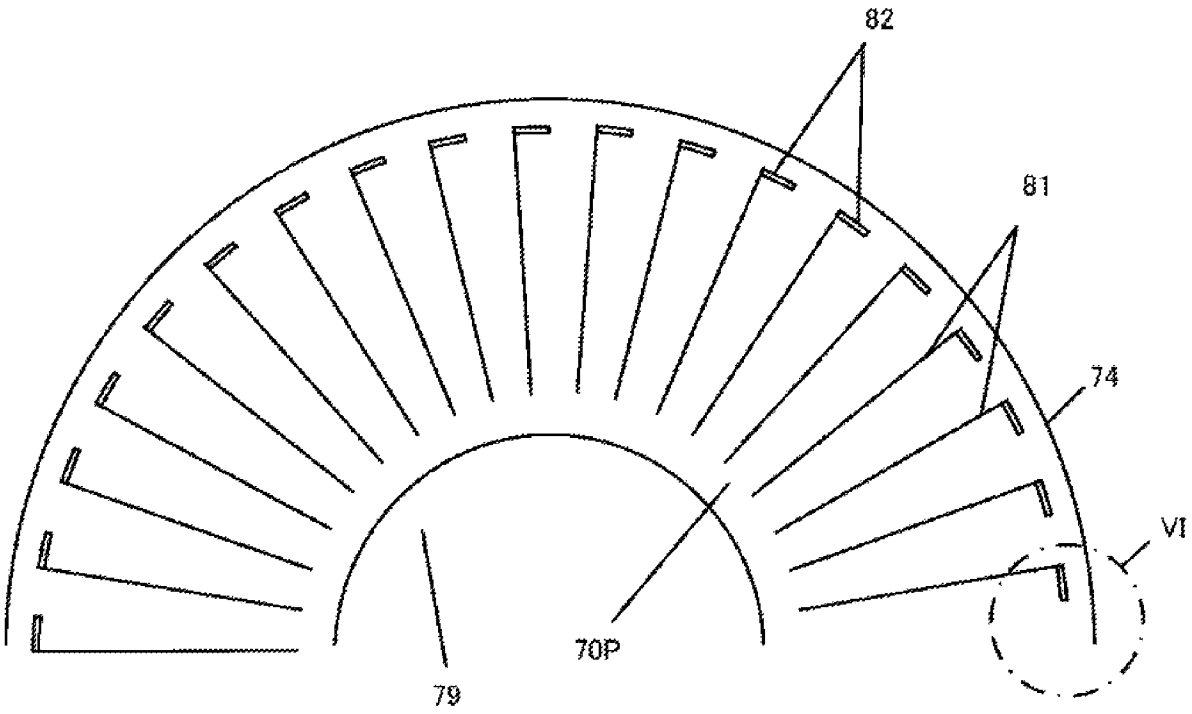
FIG. 5 is a plan view of the half-disc plate for illustrating a step following FIG. 4.

The stationary blade portion 70 has a half-disc shape in which a half-disc opening portion 79 is provided on the inner circumferential side, and is made of, for example, an aluminum alloy. The stationary blade portion 70 includes the plurality of stator blades 71 extended in a radial manner with a predetermined width in the circumferential direction. As shown in FIGS. 4 and 5, the stator blade 71 is provided so as to be inclined by a predetermined blade angle from the stationary blade portion main body 70A by the drawing of a half-disc plate 70P in which pluralities of cut lines 81 and openings 82 are formed in a radial manner. A plurality of exhaust openings 78 is formed in the stationary blade portion 70 by the drawing of the stator blades 71. The exhaust openings 78 are passages formed so as to be elongated in the radial direction, the passages through which a gas current is guided from upstream to downstream.

Referring to FIGS. 2 and 3, the stator blades 71 are formed into a substantial quadrangle in a plan view. The substantially quadrangular stator blade 71 is formed by four sides including a first side forming the outer circumferential side end 75, a second side forming the inner circumferential side end 76, a third side forming a base end 72, and a fourth side forming a side end 73. In detail, in the first side forming the outer circumferential side end 75, the cutout 75K is formed on the side of the side end 73 thereof. In this sense, a shape of the stator blade 71 in a plan view is the substantial quadrangle.

The stator blade 71 is formed to be upgrade in the circumferential direction with respect to the stationary blade portion main body 70A, and has a predetermined blade angle. That is, the stator blade 71 stands up from and is connected to the stationary blade portion main body 70A at the base end 72 extended linearly in the radial direction, and the stator blade 71 is isolated from the stationary blade portion main body 70A on the side of the side end 73 which is the opposite side of the base end 72.

The outer circumferential side end 75 of the stator blade 71 is formed into an arc shape or a straight shape along an outer circumferential surface 74 of the stationary blade portion main body 70A. In a case where the outer circumferential side end 75 is formed into an arc shape, the shape is preferably an arc of a concentric circle with the outer circumferential surface 74. The inner circumferential side end 76 of the stator blade 71 is formed into an arc shape or a straight shape along the half-disc opening portion 79. In a case where the inner circumferential side end 76 is formed into an arc shape, the shape is preferably an arc of a concentric circle with the half-disc opening portion 79. A height of the outer circumferential side end 75 of the stator blade 71 is higher than a height of the inner circumferential side end 76.

Referring to FIG. 3, the outer circumferential side support portion 75S is formed in the outer circumferential side end 75 of the stator blade 71. The stator blade 71 is formed by the drawing, and the stator blade 71 is three-dimensionally coupled to the stationary blade portion main body 70A on the outer circumferential side by the outer circumferential side support portion 75S.

The outer circumferential side support portion 75S is provided only in a part of the entire length of the outer circumferential side end 75 of the stator blade 71, that is, the entire width of the stator blade. In other words, the outer circumferential side support portion 75S is formed from the base end 72 of the stator blade 71 to an intermediate part between the base end 72 and the side end 73. The cutout 75K is provided in a part from this intermediate part to the side end 73, and the side of the side end 73 of the outer circumferential side support portion 75S is separated from the stationary blade portion main body 70A by this cutout 75K. A length of the cutout 75K is preferably less than a half of a length from the base end 72 of the stator blade 71 to the side end 73.

It should be noted that the cutout 75K is formed into a quadrangle in a plan view, and is long in the circumferential direction and short in the radial direction.

In the inner circumferential side end 76 of the stator blade 71, the inner circumferential side support portion 76S is formed over the entire length from the base end 72 to the side end 73. The stator blade 71 is formed by the drawing, and the stator blade 71 is three-dimensionally coupled to the stationary blade portion main body 70A on the inner circumferential side by the inner circumferential side support portion 76S.

The inner circumferential side end 76, the outer circumferential side end 75, and the base end 72 are connected to the stationary blade portion main body 70A, and the side end 73 is separated from the stationary blade portion main body 70A.

In such a way, the stator blade 71 is coupled to the stationary blade portion main body 70A by the outer circumferential side support portion 75S provided in the outer circumferential side end 75 and the inner circumferential side support portion 76S provided in the inner circumferential side end 76. Thus, the stator blade has large rigidity. The blade height is larger on the outer circumferential side than the inner circumferential side. However, since the cutout 75K is formed in the outer circumferential side end 75, generation of cracking in the outer circumferential side support portion 75S can be suppressed at the time of the drawing.

—Manufacturing Step of Stationary Blade Portion 70—

Next, referring to FIGS. 4 to 8, a manufacturing method of the stationary blade portion 70 will be described.

This manufacturing method includes a step of preparing the half-disc plate 70P, a step of forming the radial cut lines 81 in the half-disc plate 70P, a step of forming the openings 82 in the circumferential direction in the outermost circumferential parts of the radial cut lines 81 of the half-disc plate 70P, and a step of forming the stator blades 71 by the drawing.

Firstly, the half-disc plate 70P serving as a metal half-disc member in which the half-disc opening portion 79 is provided on the inner circumferential side is prepared. An aluminum alloy, stainless steel, and the like can be used as a material of the half-disc plate 70P.

As shown in FIG. 4, the plurality of straight slits 81 is formed in a radial manner in the half-disc plate 70P. A radial length of the slits 81 is a radial length of the stator blades 71. The slits 81 can be formed by pressing or etching. Edges of the slits 81 serve as the side ends 73 after the drawing.

Next, as shown in FIG. 5, the substantially rectangular openings 82 along the outer circumferential surface 74 of the half-disc plate 70P are formed in outer circumferential ends of the slits 81. Although the openings 82 are formed by the pressing for efficiency, the openings may be formed by the etching. The openings 82 serve as the cutouts 75K after the drawing.

By a die and a punch, the stator blades 71 are drawn from the half-disc plate 70P. Hereinafter, referring to FIGS. 6 to 8, the drawing will be described in detail.

Figure 6:
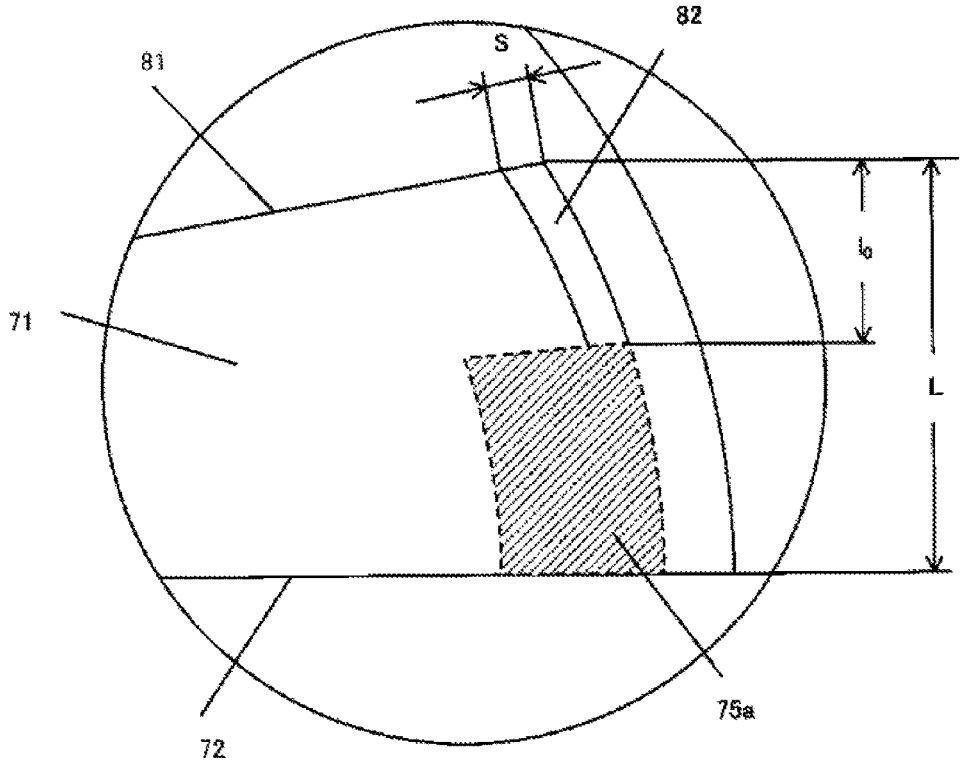
FIG. 6 is an enlarged view of a region VI in FIG. 5.

FIG. 6 is an enlarged view of a region VI in FIG. 5. In FIG. 6, a region 75*a* shown by hatching of diagonal lines is a region becoming the outer circumferential side support portion 75S for coupling the stationary blade portion main body 70A and the outer circumferential side end 75 by the drawing. A length 10 of the opening 82 is desirably less than a half of a length L of the outer circumferential side end 75 of the stator blade 71.

Figure 7A:
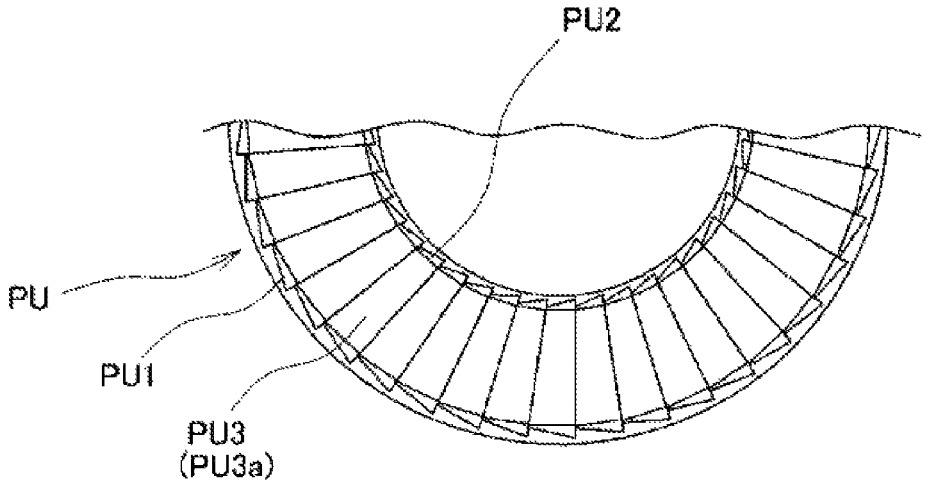
FIG. 7A is a plan view of a punch.
Figure 7B:
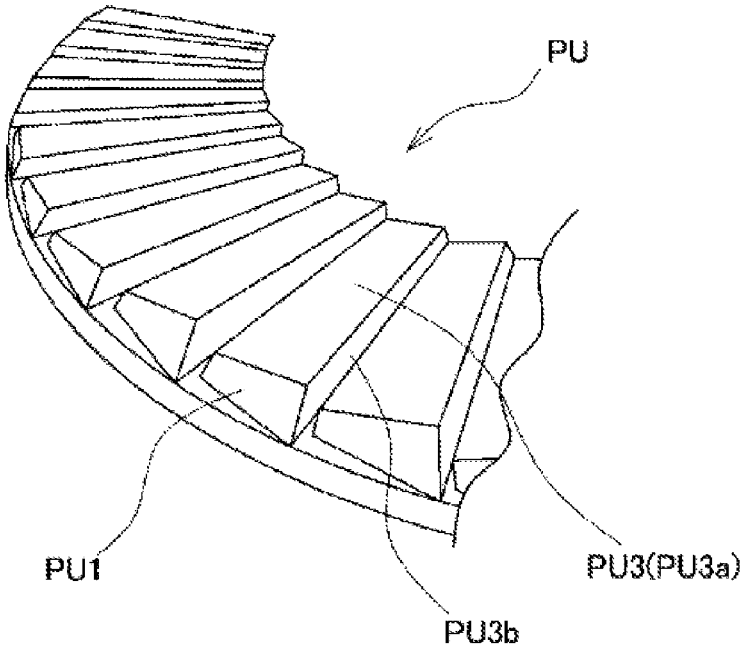
FIG. 7B is a perspective view of the punch.
Figure 8A:
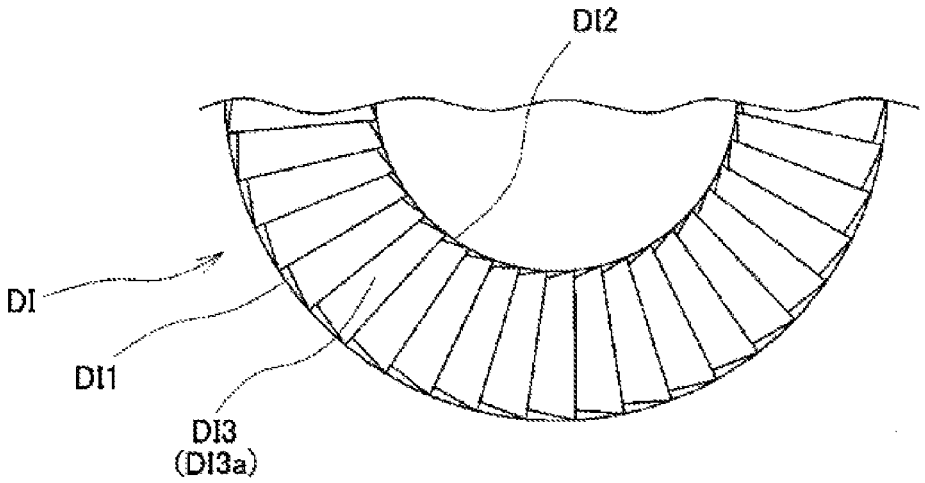
FIG. 8A is a plan view of a die.
Figure 8B:
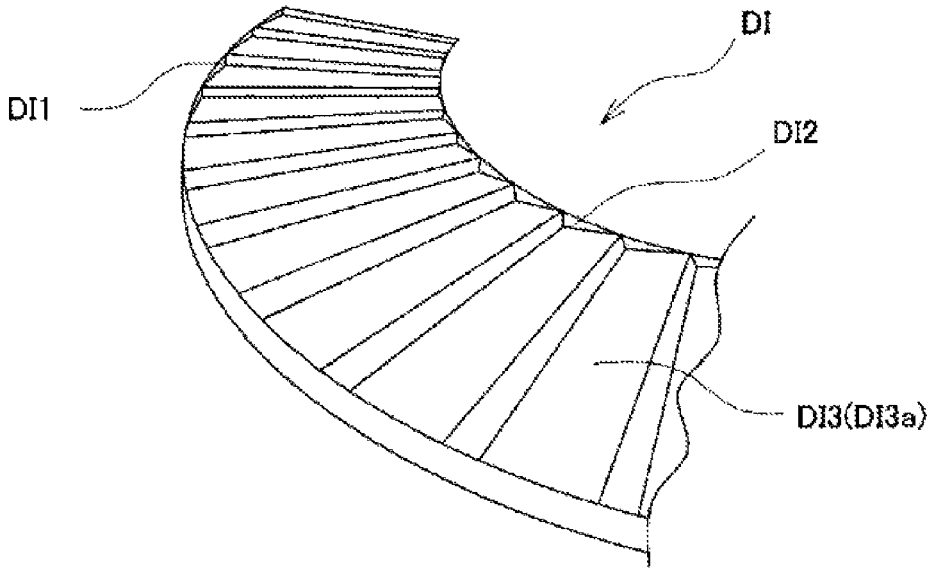
FIG. 8B is a perspective view of the die.
Figure 9A:
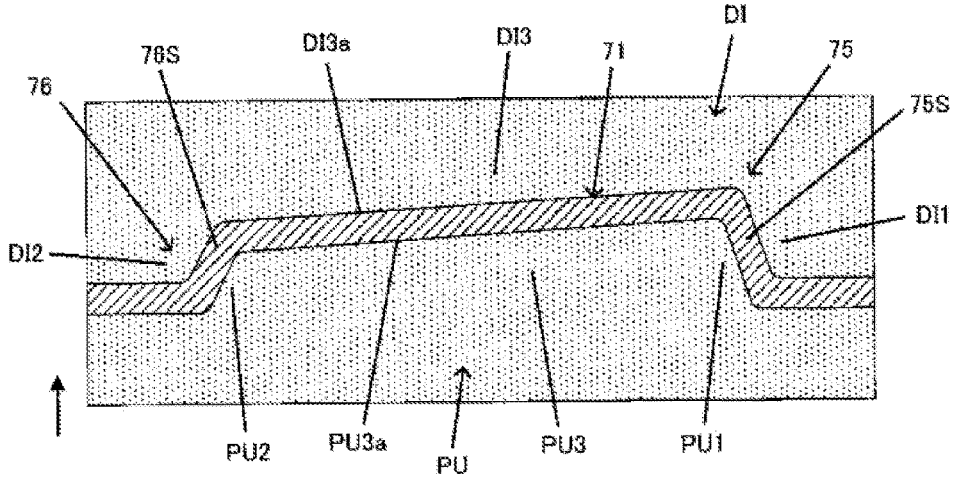
FIGS. 9A and 9B are views for illustrating a method of manufacturing a stator blade 71 by drawing with using a punch PU and a die DI.
Figure 9B:
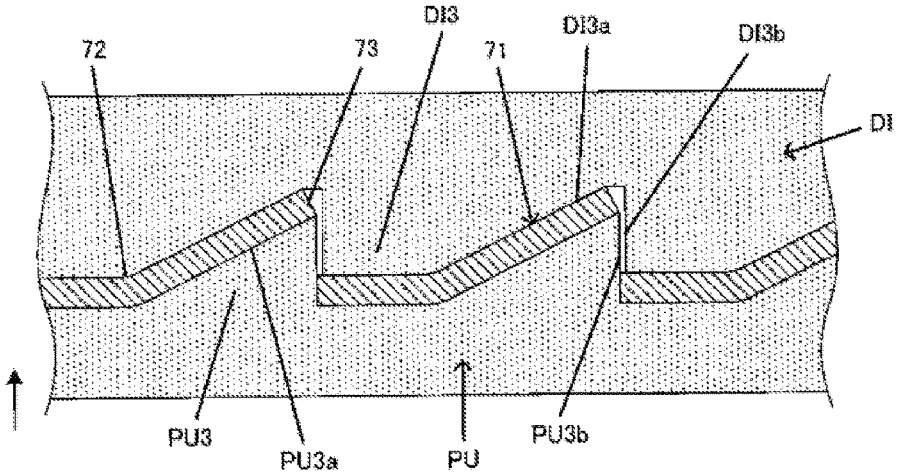

FIG. 7A is a plan view of the punch, FIG. 7B is a perspective view of the punch, FIG. 8A is a plan view of the die, and FIG. 8B is a perspective view of the die. FIGS. 9A and 9B are views for illustrating the method of manufacturing the stator blade 71 by the drawing with using a punch PU and a die DI, FIG. 9A is a sectional view taken along the line IXa-IXa in FIG. 2 at the time of the drawing, and FIG. 9B is a sectional view taken along the line IXb-IXb in FIG. 2 at the time of the drawing.

As shown in FIGS. 7A, 7B, and 9A, the punch PU has an inclined portion PU1 ascending from the side of the outer circumferential side end 75 toward the side of the inner circumferential side end 76 for forming the outer circumferential side support portion 75S of the stator blade 71, and an inclined portion PU2 ascending from the side of the inner circumferential side end 76 toward the side of the outer circumferential side end 75 for forming the inner circumferential side support portion 76S of the stator blade 71. The punch PU includes a punch main body portion PU3 having an inclined surface PU3*a* ascending from the base end 72 of the stator blade 71 toward the side end 73. As shown in FIGS. 7A, 7B, and 9B, a side end surface PU3*b* substantially parallel to the axial direction of the rotor shaft 5 is formed at a position of the punch main body portion PU3 corresponding to the side end 73. The side end surface PU3*b* is to separate the side end 73 of the stator blade 71 from the base end 72.

As shown in FIGS. 8A, 8B, and 9A, the die DI has an inclined portion DI1 descending from the side of the outer circumferential side end 75 toward the side of the inner circumferential side end 76 for forming the outer circumferential side support portion 75S of the stator blade 71, and an inclined portion DI2 descending from the side of the inner circumferential side end 76 toward the side of the outer circumferential side end 75 for forming the inner circumferential side support portion 76S of the stator blade 71. The die DI includes a die main body portion DI3 having an inclined surface DI3*a* descending from the base end 72 of the stator blade 71 toward the side end 73. As shown in FIGS. 8A, 8B, and 9B, a side end surface DI3*b* substantially parallel to the axial direction of the rotor shaft 5 is formed at a position of the die main body portion DI3 corresponding to the side end 73. The side end surface DI3*b* is to separate the side end 73 of the stator blade 71 from the base end 72.

The half-disc plate 70P is set on the die DI, the punch PU is pushed out in the arrow direction, and the drawing is performed to the half-disc plate 70P, so that the stator blade 71 is manufactured. In this drawing, a three-dimensional plastic flow is generated in the region 75*a* of the diagonal lines of FIG. 6, so that the outer circumferential side support portion 75S is formed. By the plastic deformation of the region 75*a*, the opening 82 is three-dimensionally deformed in the blade height direction from a flat shape, so that the cutout 75K is formed.

As described above, according to the above embodiment, the following effects are obtained.

(1) In the vacuum pump according to the present invention, at least one stationary blade portion 70 among the plural stages of the stationary blade portions 70, that is, the stationary blade portions 70*b* to 70*d* having the large blade angle and the large blade height of an outer circumferential part are manufactured by the drawing. Therefore, in comparison to a case where the stationary blade portions are manufactured by the mechanical working, cost of the vacuum pump can be reduced.

(2) In the stationary blade portion 70, by the pressing drawing of the half-disc plate 70P by the die DI and the punch PU as shown in FIG. 8, the outer circumferential side end 75 and the inner circumferential side end 76 of the stator blade 71 are connected to the stationary blade portion main body 70A by the outer circumferential side support portion 75S and the inner circumferential side support portion 76S. Therefore, the rigidity of the stator blade 71 can be increased.

(3) In the support portion 75S of the outer circumferential side end 75 having the large blade height, the cutout 75K is provided in the part from the side end 73 facing the base end 72 to the intermediate part of the base end 72. Thus, even in a case where the blade angle is large and the blade height is equal to or larger than a predetermined value, the generation of the cracking in the outer circumferential side support portion 75S can be prevented at the time of the drawing.

(4) In general, in a case where the outer circumferential side support portion 75S is formed by the drawing, and when the inclination angle in the radial direction of the outer circumferential side support portion 75S is increased (to be steep), the cracking is generated. Thus, the inclination angle is decreased (to be gentle) so as not to generate the cracking. When the inclination angle in the radial direction of the outer circumferential side support portion 75S provided on the side of the outer circumferential side end 75 of the stator blade 71 is decreased (to be gentle), a length of the outer circumferential side support portion 75S is extended. Thus, the radial length of a part acting as an exhaust function of the stator blade 71 is reduced. Meanwhile, in one embodiment of the present invention, the opening 82 is provided on the side of the outer circumferential side end 75 of the stator blade 71. Thus, even when the inclination angle is increased, the generation of the cracking in the drawing part can be suppressed. In such a way, the inclination angle in the radial direction of the outer circumferential side support portion 75S can be increased. Thus, an exhaust property can be improved.

(5) In general, in a case where the blade angle and the blade height of the stator blade 71 are large, and when the outer circumferential side support portion 75S of the outer circumferential side end 75 of the stator blade 71 is formed by single drawing, the cracking is easily generated. Therefore, by performing the drawing by plural times, the generation of the cracking is prevented. Meanwhile, in one embodiment of the present invention, the opening 82 is formed on the side of the side end 73 of the outer circumferential side end 75 of the stator blade 71 and the drawing is performed. Thus, even in a case where the blade angle and the blade height of the stator blade 71 are large, the outer circumferential side support portion 75S can be formed into a desired shape by single drawing without generating the cracking. Therefore, a working task becomes efficient.

Figure 10:
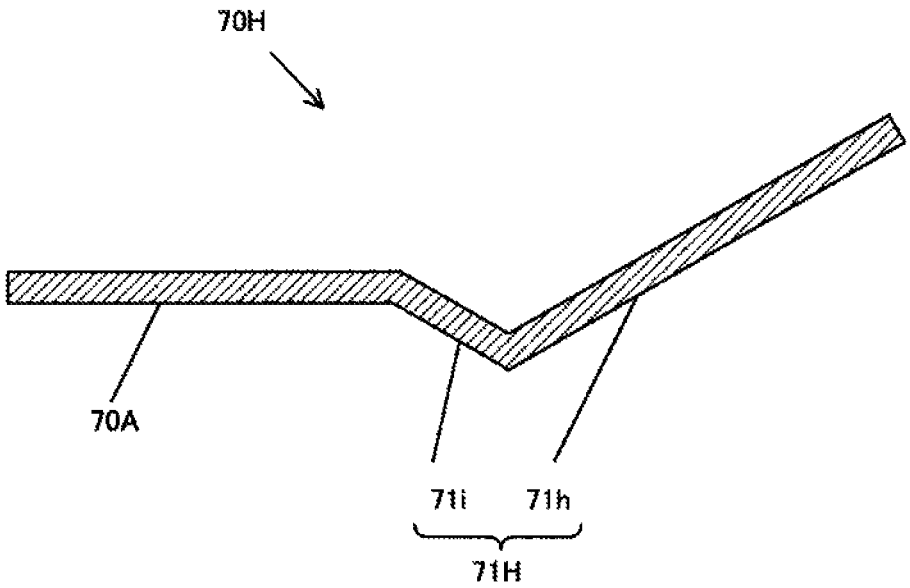
FIG. 10 is a sectional view of a stationary blade portion serving as a second embodiment of the present invention.

FIG. 10 is a sectional view showing a second embodiment of a stationary blade portion.

In a stationary blade portion 70H in the second embodiment, a stator blade 71H has a downgrade portion 71*i* and an upgrade portion 71*h*. That is, the downgrade portion 71*i* is formed from the base end 72 where the stator blade 71H is connected to the stationary blade portion main body 70A, and the upgrade portion 71*h* is formed on the front end side of the downgrade portion 71*i*.

The outer circumferential side support portion 75S described above and the cutout 75K are formed in an outer circumferential side end of such a stator blade 71H.

It should be noted that in the description of the above embodiment, the top stator blade 71*a* is manufactured by the mechanical working. However, the number of stages of the stator blades 71 to be manufactured by the mechanical working may be increased. All the stator blades 71 maybe manufactured by the drawing.

In the description of the above embodiment, the cutouts 75K are formed in the outer circumferential side support portions 75S of the stator blades 71*b* to 71*d*, and the cutouts 75K are not formed in the outer circumferential side support portions 75S of the stator blades 71*e* to 71*g*. However, a ratio of the stage number between the stator blades in which the cutouts 75K are formed in the outer circumferential side support portions 75S and the stator blades in which the cutouts 75K are not formed in the outer circumferential side support portions 75S is arbitrarily changed, and the cutouts 75K may be formed in the outer circumferential side ends 75 of all the stator blades 71*a* to 71*g*.

In the description of the above embodiment, the cutout 75K is formed only in the outer circumferential side support portion 75S of the stator blade 71, and the cutout 75K is not formed in the inner circumferential side support portion 76S of the inner circumferential side end 76. However, a cutout may be formed in the inner circumferential side end 76.

In the example of the above embodiment, the compound type turbo-molecular pump including the blade exhaust portion and the threaded groove exhaust portion is shown as an example of a vacuum pump. However, the present invention can also be applied to a vacuum pump including only a blade exhaust portion.

In addition, the present invention can be applied with various modifications within a range of the gist of the invention. That is, the present invention is the vacuum pump having the exhaust portion in which the rotating blade portions and the stationary blade portions are laminated in multiple stages, and can be applied to various types of vacuum pumps having the following configurations. That is, in at least one stage of the stationary blade portion among the plurality of stationary blade portions laminated in the multiple stages, a plurality of stator blades and exhaust openings formed so as to be elongated in the radial direction are provided. The stator blades are extended in a radial manner with a predetermined width in the circumferential direction and inclined by a predetermined blade angle with respect to a stationary blade portion main body. The exhaust openings are openings through which an air current is guided from upstream to downstream by the plurality of stator blades. Each of the plurality of stator blades is three-dimensionally connected to the stationary blade portion main body by an inner circumferential side support portion on the inner circumferential end side, and three-dimensionally connected to the stationary blade portion main body by an outer circumferential side support portion on the outer circumferential end side. A cutout is provided in a circumferential front end of the outer circumferential side support portion.

What is claimed is:

1. A vacuum pump having an exhaust portion in which rotating blade portions and stationary blade portions are laminated in multiple stages, wherein in at least one stage of the stationary blade portion among the plurality of stationary blade portions laminated in the multiple stages, a plurality of stator blades extended in a radial manner with a predetermined width in the circumferential direction and inclined by a predetermined blade angle with respect to a stationary blade portion main body, and a plurality of exhaust openings through which a gas current is guided from upstream to downstream by the plurality of stator blades are provided, each of the plurality of stator blades in one stage of the stationary blade portion is three-dimensionally connected to the stationary blade portion main body by an inner circumferential side support portion on the inner circumferential end side, and three-dimensionally connected to the stationary blade portion main body by an outer circumferential side support portion on the outer circumferential end side, and a cutout is provided in a circumferential front end of the outer circumferential side support portion, the cutout preventing the cracking in the outer circumferential side support portion from generating at the time of drawing to form the stator blade, each of the plurality of stator blades includes;

an inner circumferential end extended in the circumferential direction on the inner circumferential end side of the stator blade, an outer circumferential end extended in the circumferential direction on the outer circumferential end side of the stator blade, a base end extended in the radial direction for connecting a base part of the inner circumferential end and a base part of the outer circumferential end, and a side end facing the base end in the circumferential direction and being extended in the radial direction, the inner circumferential end, the outer circumferential end, and the base end are connected to the stationary blade portion main body, and the side end is separated from the stationary blade portion main body so as to define the exhaust opening, the cutout is provided in a front end of the outer circumferential end crossing the side end, the outer circumferential side support portion and the inner circumferential side support portion are connected to the base end, and the inner circumferential side support portion is provided over the entire length of the inner circumferential end.

2. The vacuum pump according to claim 1, wherein the cutout is formed into a quadrangle in a plan view, and is long in the circumferential direction and short in the radial direction.

3. The vacuum pump according to claim 1, wherein the outer circumferential side support portion is provided in a region of a part of the entire length from the base part of the outer circumferential end to the side end.

4. The vacuum pump according to claim 1, wherein a length of the cutout is less than a half of a length of the outer circumferential end.

5. The vacuum pump according to claim 1, wherein the cutout is formed three-dimensionally in the blade height direction.

* * * * *